United States Patent [19]

Yamin

[11] 4,274,595

[45] Jun. 23, 1981

[54] SHOWER HEAD

[76] Inventor: Amilcar F. Yamin, Rodovia Presidente Dutra Km. 380 (trevo Bonsucesso), Guarulhos (Estado de Sao Paulo), Brazil

[21] Appl. No.: 95,881

[22] Filed: Nov. 19, 1979

[30] Foreign Application Priority Data

Nov. 20, 1978 [BR] Brazil ..... 7807588

[51] Int. Cl.[3] ..... B05B 1/34

[52] U.S. Cl. ..... 239/383

[58] Field of Search ..... 239/380–383, 239/463, 472, 490, 491

[56] References Cited

U.S. PATENT DOCUMENTS

| | | | |
|---|---|---|---|
| 2,027,954 | 1/1936 | Barclay | 239/472 |
| 2,905,394 | 9/1959 | Swan | 239/383 |
| 3,713,587 | 1/1973 | Carson | 239/383 |
| 3,804,336 | 4/1974 | Koeppe | 239/383 |

*Primary Examiner*—Andres Kashnikow

*Attorney, Agent, or Firm*—Blanchard, Flynn, Thiel, Boutell & Tanis

[57] ABSTRACT

A shower head having an upper body adapted for attachment to a water supply pipe, and a lower body swivably supported on the lower end of the upper body, which bodies conjointly define a water passageway therethrough. The lower body has an internal cavity formed therein upstream of the discharge orifice, which internal cavity includes a substantially cylindrical chamber coaxially aligned with and spaced upstream from the discharge orifice. The cavity further includes a frusto-conical chamber which is of a converging funnel-shaped configuration in the downstream direction and extends axially from the cylindrical chamber to the discharge orifice. A bladed member is disposed within the cylindrical chamber for dividing the main water stream into several smaller streams and for causing these streams to be discharged into the frusto-conical chamber at different directions to effect a swirling of the streams.

2 Claims, 4 Drawing Figures

FIG. 1
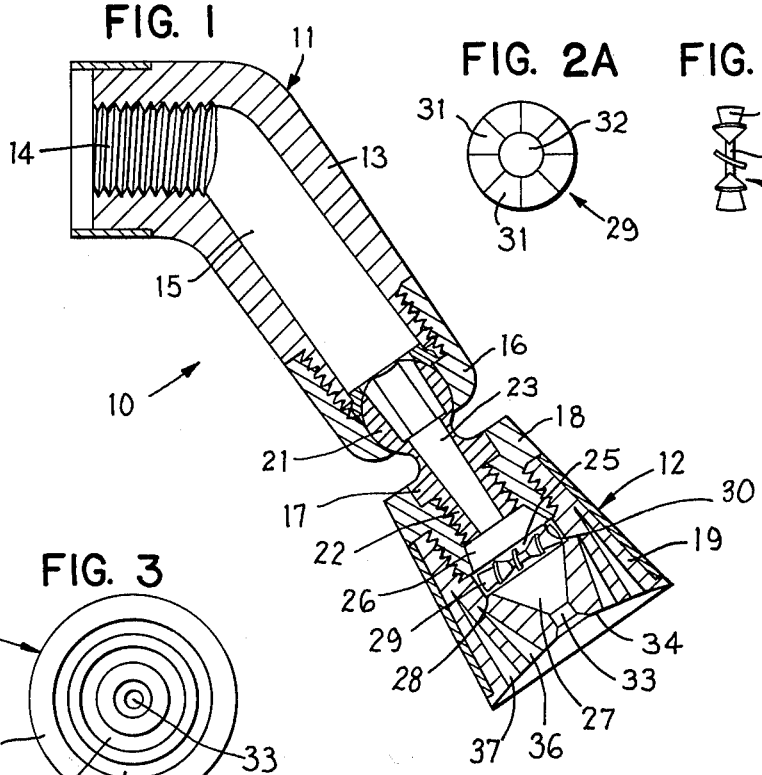
FIG. 2A
FIG. 2B
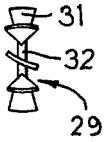
FIG. 3
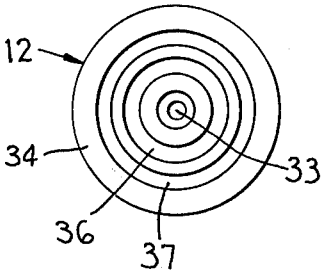

SHOWER HEAD

This invention relates to a shower head of the jet type and, in particular, to an improved shower head for permitting discharge of an improved water jet which permits more efficient utilization of a minimal quantity of water so as to achieve a uniform dispersement of water over a substantial area.

In the improved shower head of the present invention, same is provided with an upper body adapted to be connected to a pipe and/or to an electric water heater, which upper body has a lower body swivably supported thereon by means of a hollow sphere which defines a flow passage therethrough. This hollow sphere has a projecting stem portion which is threadably joined to the lower body. The lower body defines, in the interior thereof, a first frusto-conical cavity which is aligned with the flow passage and, adjacent the larger diameter end thereof defines a seat on which is positioned a bladed rotor for imparting a swirling motion to the water stream flowing through the shower head. A further frusto-conical cavity is formed in the lower body directly below the rotor, this latter cavity converging into a coaxially aligned discharge orifice through which the water jet is discharged from the lower end of the shower head. The opposed frusto-conical cavities, having the rotor positioned therebetween, break the main water stream into several smaller streams which are directed circumferentially around the lowermost cavity so that the water stream, when discharged from the discharge orifice, is uniformly dispersed and spread out over a larger area while permitting a minimum quantity of water to be utilized for discharge through the shower head.

A preferred embodiment of the present invention is illustrated in the attached drawings wherein:

FIG. 1 is a longitudinal sectional view of the improved shower head according to the invention;

FIG. 2A is a plan view of the bladed rotor;

FIG. 2B is a side view of the rotor; and

FIG. 3 is an end view of the lower or discharge end of the shower head.

Referring to FIG. 1, there is illustrated a shower head 10 according to the invention, which shower head is formed by an upper body 11 having a lower body 12 swivably supported thereon.

The upper body 11 is formed by an upper tubular portion 13 which is of an angled configuration and, at its upper end, is internally threaded at 14 to permit connection to a supply pipe or the like. The body 11 also includes a cup-shaped lower portion 16 which is threadably engaged with the lower end of the upper portion 13. This upper body 11 defines a main passage 15 therethrough for supplying a stream of water to the lower body 12.

The lower body 12 is formed by three main parts which are threadably and hence fixedly connected together in coaxial relationship, the first being the swivel part 17, the second being the upper body part 18, and the third being the lower body part 19.

The swivel part 17 is provided with a sphere or ball 21 at the upper end thereof, which ball is sealingly but swivably supported on the upper body 11, being retained by the lower body part 16. The ball 21 has a stem portion 22 fixed thereto and projecting axially therefrom, which stem is externally threaded and is thus threadably engaged within the upper body part 18. The swivel part 17 has a flow passage 23 extending coaxially throughout the length thereof, which passage at its upper end projects through the ball 21 so as to be in open communication with the passage 15.

The upper and lower body parts 18 and 19, when threaded together as illustrated in FIG. 1, define a substantially cylindrical member having an external surface which is of a truncated conical configuration. These two parts 18 and 19 cooperate to define therein an interior cavity or chamber which communicates with the lower end of the flow passage 23. This interior chamber is defined by a pair of opposed frusto-conical cavities 26 and 27 which are coaxially aligned relative to the lower body 12 and relative to the lower passage 23. The upper frusto-conical cavity 26, which is formed adjacent the lower end of the upper body part 18, communicates with and extends axially away from the lower end of the flow passage 23, being concentric and coaxially aligned therewith. This frusto-conical cavity 26 diverges outwardly similar to a funnel as it projects axially toward the lower end of the body. Adjacent the lower or large-diameter end of the cavity 26, there is formed a cylindrical cavity 25 which terminates in an annular seat 28, which seat supports thereon a bladed wheel or rotor 29, the latter being positioned within the cylindrical cavity 25. This wheel 29, as shown in greater detail in FIGS. 2A and 2B, includes a plurality of inclined blades 31 disposed in surrounding relationship to a central hole 32, which hole is aligned with the passage 23. This bladed wheel 29, which functions as a whirling element so as to cause a swirling of the water passing through the shower head, is normally freely supported on the seat 28 and is thus free to rotate in response to the reaction caused by the passage of water through the shower head. The end of upper body part 18 also terminates in an annular seat 30 which surrounds the large-diameter end of cavity 26. This seat 30 is spaced from but opposed to the seat 28 so that the wheel 29 is axially confined between the body parts 18 and 19, whereby the wheel is rotatable but axially confined, without being fixedly or structurally connected to the body parts. Further, the center of the bladed element can be closed, if desired, rather than being provided with the opening 32.

The other frusto-conical cavity 27 is formed within the lower body part 19 and is disposed downstream of the bladed wheel 29. This cavity 27 begins at the seat 28 and extends coaxially downwardly therefrom. The cavity 27 is of a converging funnal-shaped configuration which, at its small-diameter end, communicates with a small discharge hole or orifice 33, which hole 33 is also coaxially aligned with passage 23. The hole 33 opens outwardly through the bottom surface 34 of the lower body 12, which lower surface 34 is of a generally concave or inwardly rounded configuration.

The lower body part 19 is also provided with a pair of annular grooves 36 and 37 projecting axially inwardly from the lower surface 34. These grooves 36 and 37, which are concentric relative to one another and relative to the discharge orifice 33, project axially inwardly of the part 19 to a limited axial extent, the individual grooves having a triangular or funnel-shaped cross section. These latter grooves reduce the quantity of material in the lower body part, and at the same time improve the appearance of the shower head.

In operation, the stream of water as supplied from a conventional water pipe or the like enters the upper end of the passage 15 and flows therethrough into the passage 23, from which water is discharged into the cavity 26. The stream of water supplied into cavity 26 is directed against the bladed wheel 29, the latter being freely rotatable. The plural inclined blades 31 cause the stream of water, when passing axially across the wheel, to be divided into several smaller streams, with these individual streams all being directed at slightly different directions due to the inclination of the blades. These differently directed smaller streams, as discharged into the lower cavity 27, have a swirling or whirling movement imparted thereto. These whirling streams are then converged as they pass axially downwardly of the frusto-conical cavity 27, with the water then being discharged through the discharge orifice 33.

Due to the whirling or swirling of the water as caused by the upper and lower frusto-conical cavities and the positioning of the bladed element therebetween, the stream of water as discharged from the orifice 33 achieves a substantial spreading of the water in the shape of a jet stream, which spreading occurs over a large area in relationship to the quantity of water being discharged, and a uniform spreading or distribution of the water occurs throughout the area of the discharged jet.

Accordingly, the improved shower head thus permits more efficient and practical usage of water, permitting minimization in the quantity of water discharged from the shower head, and at the same time permits a more desirable and uniform distribution of the water, so that the resultant discharged jet has a more homogeneous distribution of water droplets, with this distribution occurring over a larger area.

I claim:

1. Improvements in a shower head assembly which is constituted by an upper body mountable on a water supply pipe or an electric water heater, and a lower body articulately mounted on the upper body through a hollow sphere, wherein the sphere is swivably seated on the upper body and has a projecting pipelike part which is threadably engaged with and surrounded by an upper part of the lower body, the sphere and the pipelike part having a flow channel extending axially therethrough, the lower body also having a lower part which is threadably fixed to said upper part, said lower body having a cylindrical cavity defined therein, said cavity being in communication and substantially coaxially aligned with said channel, said cylindrical cavity being defined in part at one end by a lower annular seat formed on said lower part, a rotorlike element freely and rotatably positioned within said cylindrical cavity and rotatably supported on said lower seat, said rotorlike element having a plurality of inclined blades for causing the stream of water when passing therethrough to be divided into a plurality of smaller streams which are deflected in different directions and are imparted with a circumferential swirling motion, said lower part also including a frusto-conical chamber which is in direct communication with and disposed directly below said cylindrical cavity, said frusto-conical chamber being coaxially aligned with and extending axially away from said cylindrical cavity and being of a converging funnel-like shape which terminates at a small discharge orifice located at the lower end of said lower part, said upper part also including a further frusto-conical chamber disposed directly above and in direct coaxial communication with said cylindrical cavity, said further frusto-conical chamber extending axially from the lower end of said flow channel and diverging radially outwardly with a funnel-like shape and terminating at the upper end of said cylindrical cavity, said upper part terminating at its lower end in an upper annular seat which surrounds the large-diameter end of said further frusto-conical chamber, said upper annular seat being axially spaced from but disposed opposite said lower annular seat, said rotorlike element being confined between said upper and lower parts by being confined solely within said cylindrical cavity and axially between said upper and lower annular seats, said rotorlike element being free of any fixed or structural connection to said upper and lower parts.

2. A shower head assembly according to claim 1, wherein the lower body is of a truncated frusto-conical configuration, the lower part having an internal cylindrical recess formed therein which extends from the upper axial end of said cylindrical cavity to the upper end of said lower part, said internal cylindrical recess being internally threaded and coaxially aligned with said cylindrical cavity, said upper part including a tubular portion at the lower end thereof which is externally threaded and is threadably received within said internal cylindrical recess for threadably connecting the upper and lower parts together, the tubular portion on said upper part having said further frusto-conical chamber formed therein and projecting upwardly from the lower axial end face thereof, the lower axial end face of said tubular portion also defining said upper annular seat, and the lower axial end face of said lower part being of a generally concave or inwardly rounded surface with said discharge orifice opening outwardly through the center of this latter-mentioned surface.

* * * * *